United States Patent [19]

Storey

[11] Patent Number: 4,487,100

[45] Date of Patent: Dec. 11, 1984

[54] ADJUSTABLE MUSICAL BRIDGE ASSEMBLY

[76] Inventor: David C. Storey, 737 Pine St. #33, San Francisco, Calif. 94108

[21] Appl. No.: 597,655

[22] Filed: Apr. 2, 1984

Related U.S. Application Data

[63] Continuation of Ser. No. 413,490, Aug. 31, 1982, , which is a continuation-in-part of Ser. No. 260,977, May 6, 1981, abandoned.

[51] Int. Cl.[3] ..... G10D 3/04

[52] U.S. Cl. ..... 84/299; 84/307

[58] Field of Search ..... 84/267, 297 R, 298, 84/299, 307, 312, 313, 314

[56] References Cited

U.S. PATENT DOCUMENTS

| | | | |
|---|---|---|---|
| 2,846,915 | 8/1958 | Daria | 84/307 |
| 3,237,502 | 3/1966 | Moseley | 84/307 X |
| 3,479,917 | 11/1969 | Zitnik et al. | 84/313 X |
| 4,135,426 | 1/1979 | Rickard | 84/307 X |
| 4,361,068 | 11/1982 | Schaller | 84/299 |
| 4,366,740 | 1/1983 | Tripp | 84/298 |
| 4,430,919 | 2/1984 | Matsui | 84/299 |
| 4,453,443 | 6/1984 | Smith | 84/298 |

*Primary Examiner*—Lawrence R. Franklin

*Attorney, Agent, or Firm*—Laubscher & Laubscher

[57] ABSTRACT

A combined bridge and tailpiece assembly for a stringed musical instrument such as a guitar is disclosed, characterized by a tailpiece member which is manually rotated to produce a vibrato effect. The assembly includes a tailpiece block which is secured to the body portion of the instrument and an elongate tailpiece member rotatably connected at its ends with the tailpiece block for rotation in one direction about an axis parallel with and eccentrically horizontally and vertically offset from the longitudinal axis of the tailpiece member to provide camming action. Adjustable string attachment devices are connected with the tailpiece member for attachment to the ends of the instrument strings which, when tensioned, normally bias the tailpiece member in one direction of rotation. A plurality of adjustable saddle rollers are connected with the tailpiece block and act as a bridge to guide the instrument strings to the string attachment devices. The tailpiece member is spring biased in the other direction of rotation to resist the rotating force exerted on the tailpiece member by the tensioned strings, and at least one lever is connected with the tailpiece member for rotating the same relative to the tailpiece block during sounding of the instrument to produce a vibrato effect.

7 Claims, 28 Drawing Figures

Fig. 1
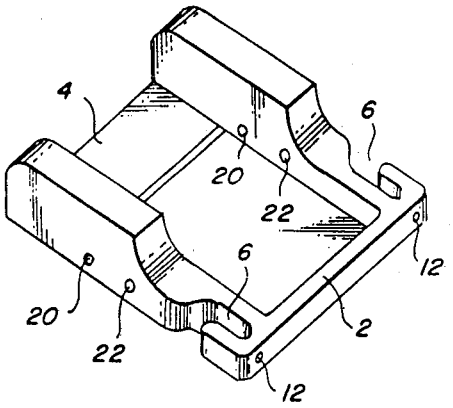
Fig. 2
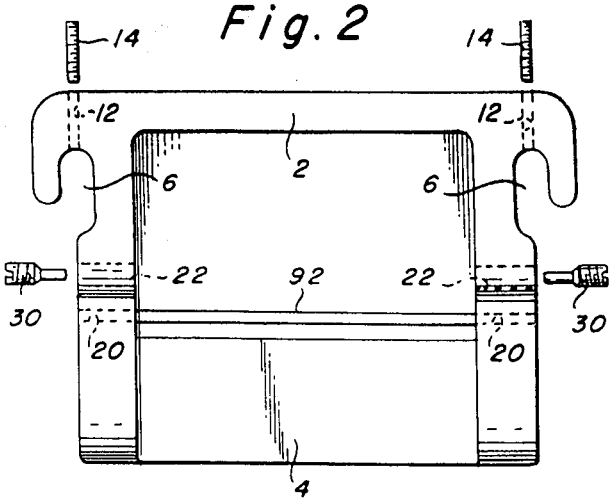
Fig. 9e
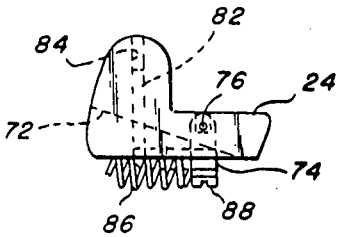
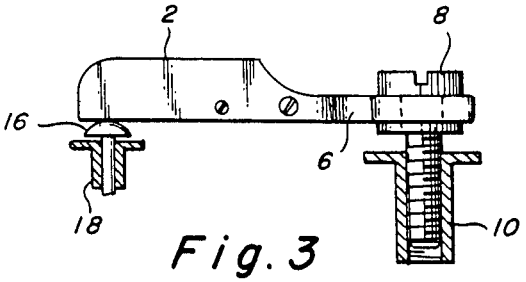
Fig. 3
Fig. 9d
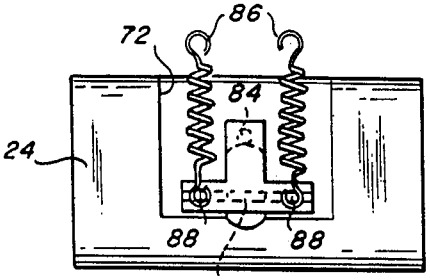
Fig. 9a
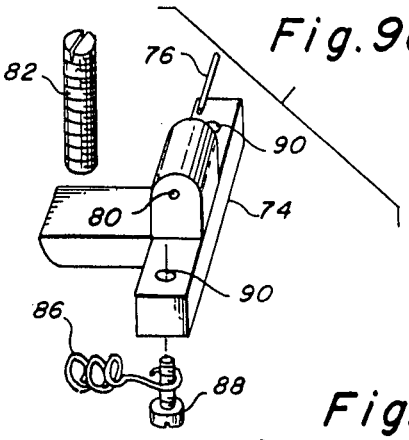
Fig. 9b
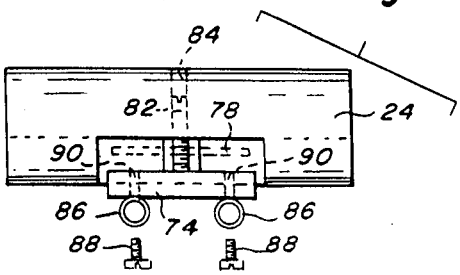
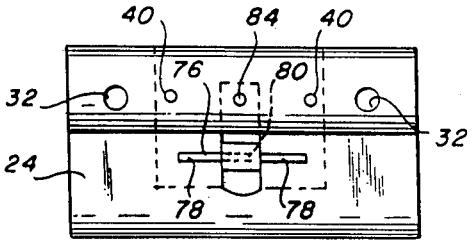
Fig. 9c

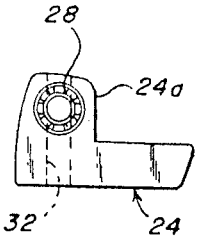
Fig.8a
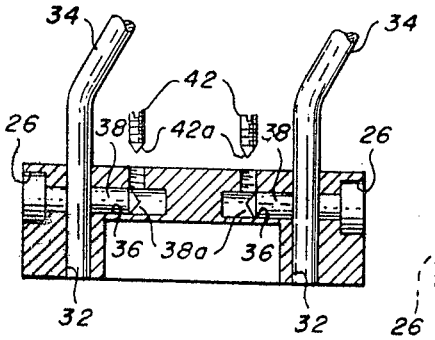
Fig.8b
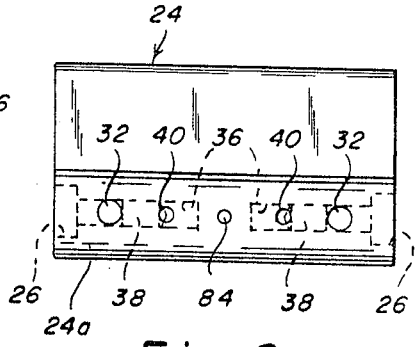
Fig.8c
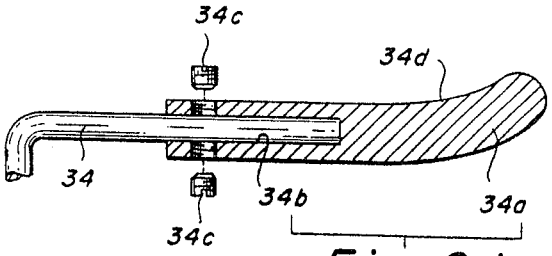
Fig.8d
Fig.12b
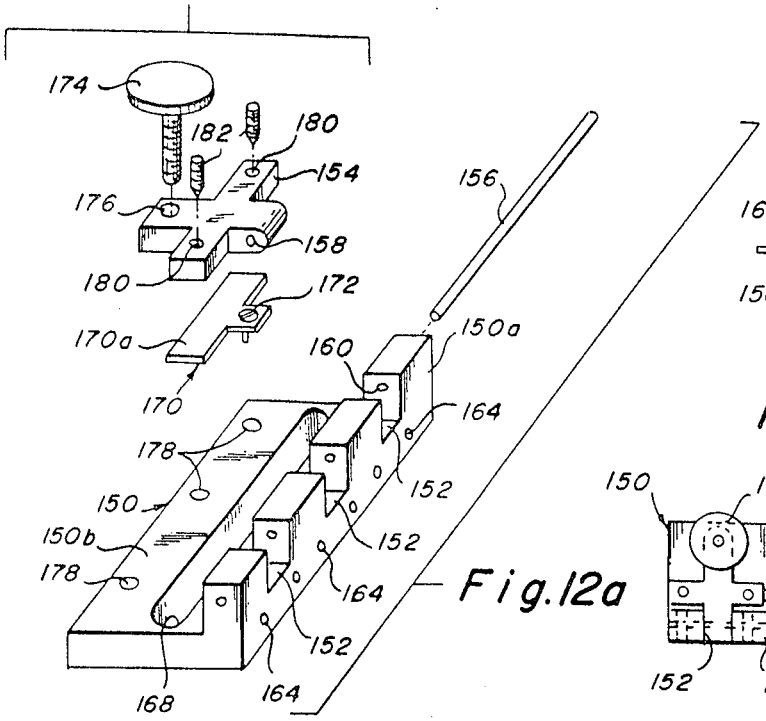
Fig.12a
Fig.12c
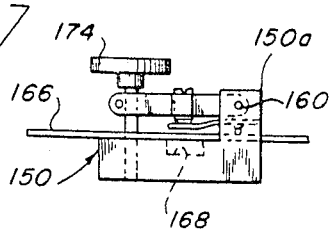
Fig.12d
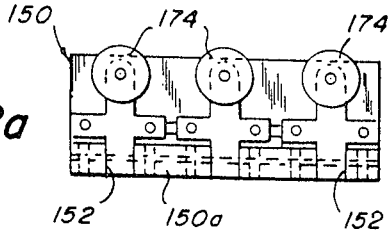

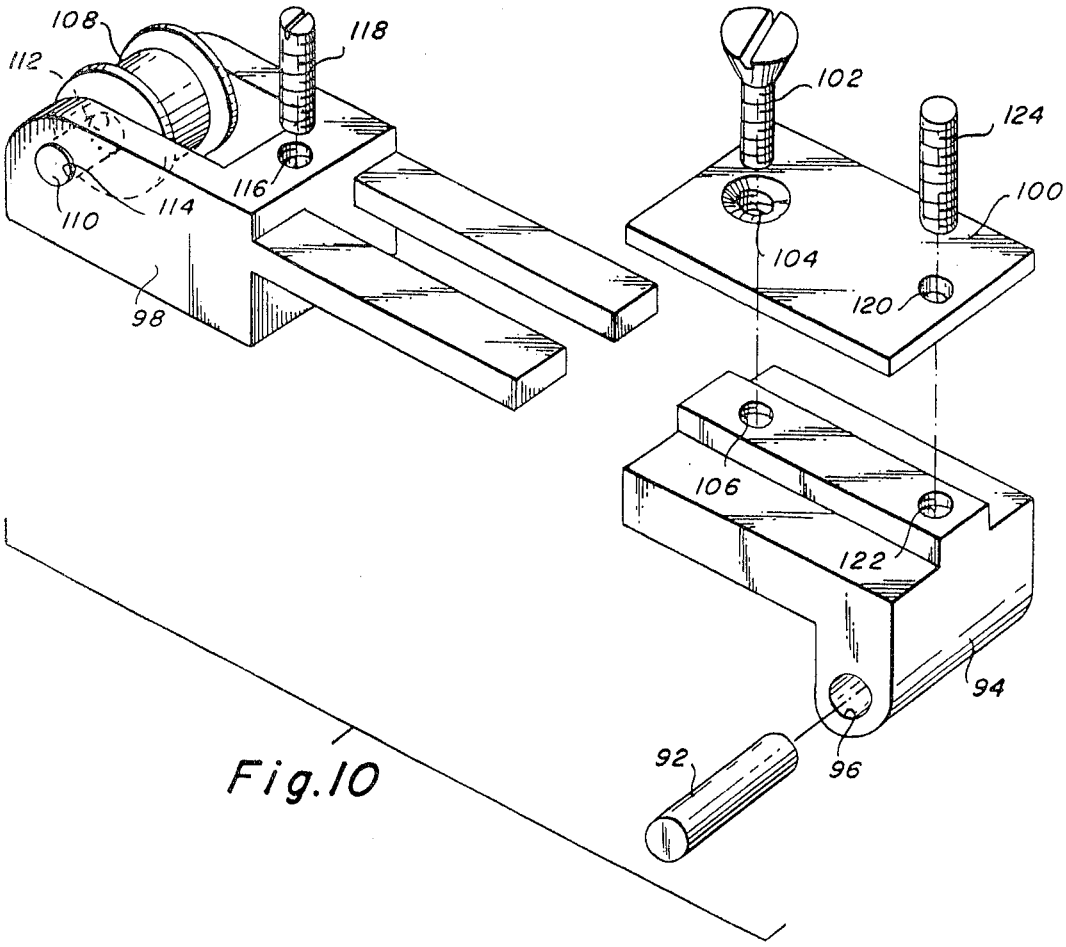
Fig.10
Fig. 11a
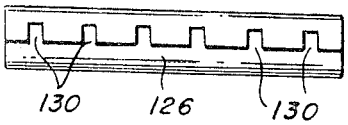
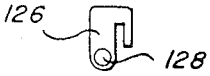
Fig.11b
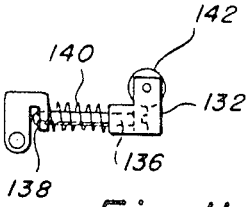
Fig.11c
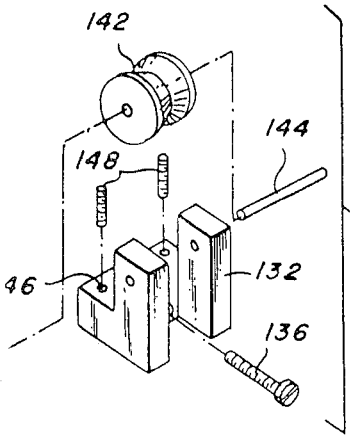
Fig.11d
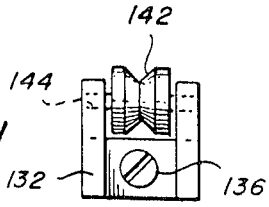
Fig.11e
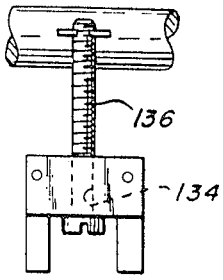
Fig.11f

ADJUSTABLE MUSICAL BRIDGE ASSEMBLY

BACKGROUND OF THE INVENTION

This application is a continuation of application Ser. No. 413,490 filed Aug. 31, 1982 which, is a continuation-in-part of application Ser. No. 260,977 filed May 6, 1981 now abandoned.

The present invention relates to an improved bridge and tailpiece assembly for a stringed musical instrument wherein a tailpiece member to which the strings are attached is rotatable to vary the tension on the strings, thereby to produce a vibrato effect during sounding of the instrument. The improved assembly is fully adjustable and yet has a compact configuration for versatile applications to stringed instruments.

BRIEF DESCRIPTION OF THE PRIOR ART

Vibrato devices for stringed musical instruments are well-known in the patented prior art as evidenced by the U.S. patents to Moseley No. 3,237,502 and Cole No. 3,466,962 and by the British Pat. No. 905,447 to Underdown. The British patent, for example, discloses a vibrato bridge including a base having a platform pivotal thereon. A bridge is arranged on the platform adjacent the pivot and parallel to the axis thereof, and string attachment means are attached to the platform at one side of the bridge and pivot. A lever arm is attached to the platform to pivot the same on the base to change the tension on the strings, thereby to produce a vibrato effect.

The Moseley patent discloses a vibrato unit for stringed instruments which includes an adjustable bridge for adjusting the pitch of individual strings. The vibrato unit is mounted on a base for rotation relative thereto to produce a vibrato effect. Similarly, the Cole patent discloses a tremolo device wherein an eccentrically mounted cradle member is rotated relative to a base plate to vary the tone of the sounded strings.

While the prior devices normally operate quite satisfactorily, they each possess certain inherent drawbacks which limit their versatility. In order to produce the clearest tones from a vibrato device, it is necessary to be able to adjust both the string securing devices and the bridge in as many directions as possible for each individual string. The adjustments must be easy to perform by the user of the instrument and the device must not be awkward or bulky on the face of the instrument. The prior devices do not completely fulfill these needs.

The present invention was developed to provide all of the above features in a combined bridge and tailpiece assembly which is quickly and easily secured to the body of a stringed musical instrument. The assembly has a clean, functional appearance which makes an attractive addition to the instrument while still being completely functional. The assembly includes a bridge characterized by four-way adjustments to fine tune each of the strings of the instrument and a rotatable tailpiece member upon which different string attachment devices are removably mounted for increased versatility. Furthermore, the vibrato effect produced by the assembly is improved owing to the camming action of the tailpiece member during rotation thereof about an axis parallel with and eccentrically horizontally offset from the longitudinal axis of the tailpiece member.

SUMMARY OF THE INVENTION

Accordingly, it is a primary object of the present invention to provide a combined bridge and tailpiece assembly for a stringed musical instrument including a tailpiece block secured to the body of the instrument and an elongate tailpiece member having a generally L-shaped vertical cross-sectional configuration. The tailpiece member is connected at its ends with the tailpiece block for rotation in one direction about an axis parallel with and eccentrically horizontally and vertically offset from the longitudinal axis of the tailpiece member to provide camming action to the rotating tailpiece member. Longitudinally spaced attachment means are connected with the tailpiece member for attachment to the ends of the instrument strings, respectively, whereby tensioning of the instrument strings normally biases the tailpiece member in one direction of rotation. An adjustable bridge is connected with the tailpiece block and includes a plurality of saddle rollers for guiding the instrument strings to the attachment means, respectively. At least one spring is connected with the tailpiece member to bias it in the other direction of rotation, thereby to resist the rotating force exerted on the tailpiece member by the tensioned strings. A lever is connected with the tailpiece member for manually rotating the same relative to the tailpiece block during sounding of the instrument to produce a vibrato effect.

According to a more specific object of the invention, the tailpiece member includes ball bearing means for connecting the member with the tailpiece block.

It is a further object of the invention to provide string attachment means which are adjustable in the horizontal direction.

According to yet another object of the invention, the bridge is adjustable in the horizontal, vertical, and longitudinal directions for each instrument string, with the saddle rollers further providing rotational variation for support of each string.

A further object of the invention is to provide, in conjunction with the tailpiece assembly, a string securing device connected with the neck of the instrument behind the instrument nut, whereby displacement of the strings relative to the nut is avoided in order to prevent variation in the tones produced by the strings when the tailpiece member is operated.

BRIEF DESCRIPTION OF THE FIGURES

Other objects and advantages will become apparent from a study of the following specification when viewed in the light of the accompanying drawing, in which:

FIGS. 1, 2, and 3 are perspective, top plan, and side views, respectively, of the tailpiece block of the assembly;

FIGS. 8*a*, 8*b*, and 8*c* are side, sectional, and top views, respectively, of the tailpiece assembly illustrating the mounting arrangement of the levers;

FIG. 8*d* is a sectional view of a lever having an adjustable handle;

FIGS. 9a–9e are perspective, rear, top, bottom and side views, respectively, of the tailpiece member illustrating the mounting arrangment of the adjustable spring biasing means;

FIG. 10 is an exploded view of a bridge element for supporting one of the instrument strings;

FIGS. 11a–11f illustrate an alternate embodiment of the assembly bridge;

FIGS. 12a–12d illustrate a string securing device adapted to be mounted behind the nut of the instrument and FIG. 13 is a perspective view of a preferred embodiment of the combined bridge and tailpiece assembly.

DETAILED DESCRIPTION

Figure 4:
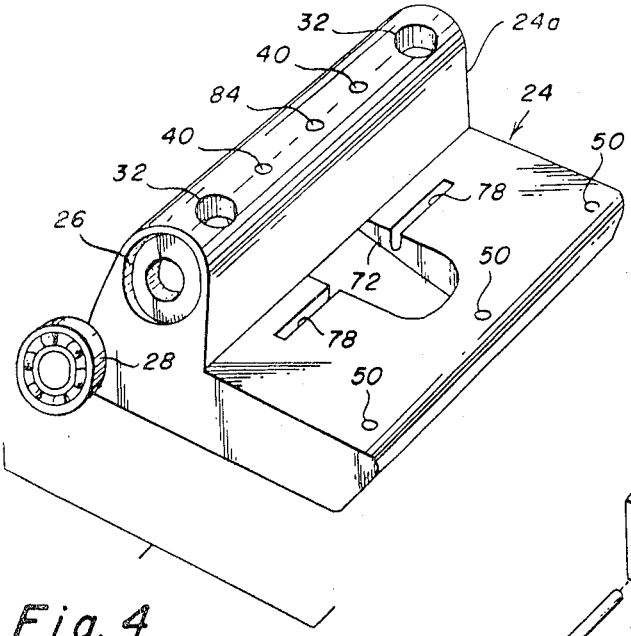
FIG. 4, is an exploded view of the tailpiece member.

Referring first more particularly to FIGS. 1, 2, and 3, the tailpiece block 2 of the combined bridge and tailpiece assembly is shown. The block has a generally U-shaped configuration with a cross member 4 connected between the forward ends thereof. The block includes a pair of recesses 6 adapted to receive vertically adjustable mounting studs 8 (FIG. 3) which are screwed into sleeves 10 in the body portion of a stringed musical instrument (not shown). A pair of through-openings 12 are arranged in the tailpiece block adjacent the pair of recesses, respectively. The openings 12 are adapted to receive a pair of screws 14 which when working on the inner portions of the studs 8 are used for horizontally adjusting the tailpiece assembly relative to the instrument body when the assembly is mounted on the body. The forward portions of the tailpiece block 2 are adapted to rest and slide on auxiliary domed studs 16 which are pressed into auxiliary sleeves 18 arranged in the instrument body. The tailpiece block further includes two pairs of aligned threaded through-openings 20,22 for purposes to be described in greater detail below.

The tailpiece member 24 will be described with reference to FIGS. 4 and 6. As shown therein, the member has a generally L-shaped vertical cross-sectional configuration including generally horizontal and vertical leg portions. The upper vertical leg portion 24a of the tailpiece member contains at its opposite ends longitudinal openings 26 adapted to receive ball bearing races 28, respectively, which are used to rotatably connect the tailpiece member with the tailpiece block. Specifically, the tailpiece member is arranged within the opening of the tailpiece block between the cross member 4 and the forward portion thereof, with the ball bearing races 28 arranged opposite the aligned apertures 22 of the tailpiece block. Screws 30 (FIG. 2) are screwed into the threaded openings 22 and, in turn, the smaller diameter portions of the screws 30 pass through the central portions of the ball bearing races 28 to connect the vertical leg portion 24a of the tailpiece member at its ends with the tailpiece block of the assembly. A characterizing feature of the invention is the arrangement of the tailpiece member relative to the tailpiece block. As shown in FIG. 4, the longitudinal axis of rotation of the tailpiece member adjacent the free edge of the vertical leg portion 24a is eccentrically horizontally and vertically offset from the longitudinal axis of the tailpiece member, thereby to provide camming action relative to the tailpiece block during rotation of the member.

Referring now to FIGS. 8a, 8b, and 8c, the upper vertical leg portion 24a of the tailpiece member includes a pair of vertically arranged openings 32 adapted to receive a lever 34 which is operable to manually rotate the tailpiece member. The lower portions of the opening 32 and lever 34 are threadably connected. As shown more particularly in FIGS. 8b and 8c, means are provided for adjusting the play of two levers within the two openings, wherein one lever may be used by a left-handed player of the stringed instrument and the other may be used by a right-handed player. Specifically, the tailpiece member contains a pair of longitudinal openings 26 which communicate with the openings 32, respectively, and which are adapted to receive plungers 38 having conical ends 38a. Vertical threaded openings 40 communicate with the openings 36, respectively, and are adapted to receive threaded screws 42 having conical ends 42a. Tightening of the screws 42 downwardly pushes the plungers 38 outwardly to bear against the levers 34, respectively to limit the play of the levers within the openings 32.

As shown in FIG. 8d, the lever 34 includes an adjustable handle 34a containing a channel 34b within which the lever is arranged. The handle may be horizontally displaced relative to the lever in accordance with the user's preference. Grub screws 34c are tightened against the lever to lock the handle in position. The bend 34d at the end of the handle can be arranged in a variety of positions including rotational adjustment relative to the lever by tightening the grub screws.

Figure 5:
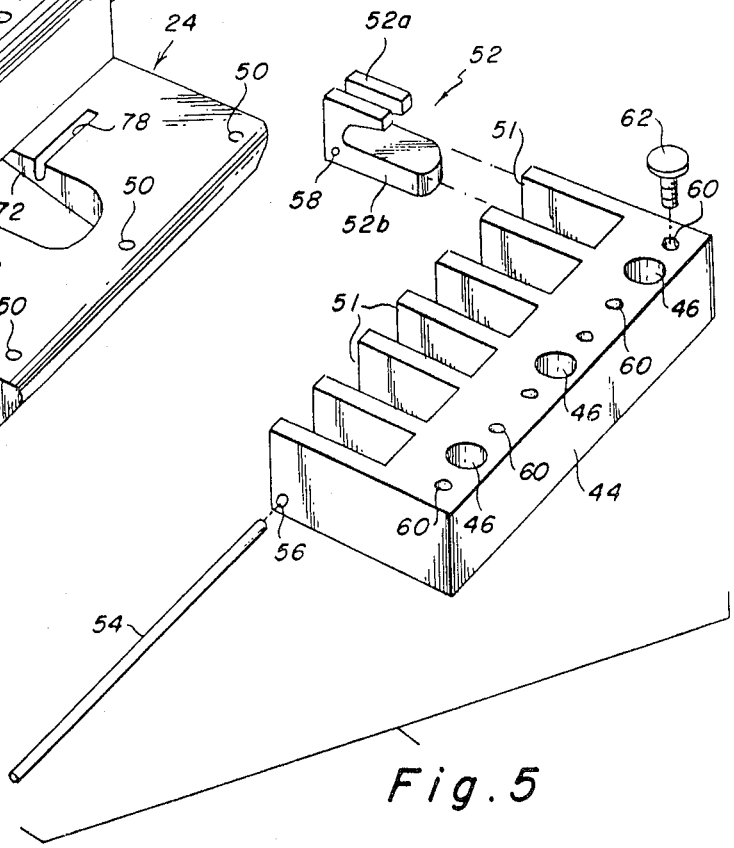
FIG. 5 is an exploded perspective view of an adjustable string attachment device.
Figure 7:
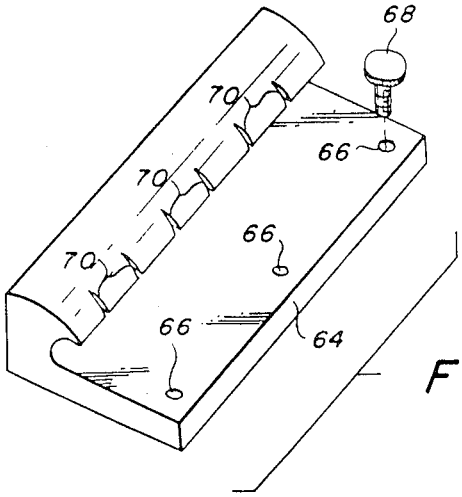
FIG. 7 is a perspective view of an alternate string attachment device.
Figure 6:
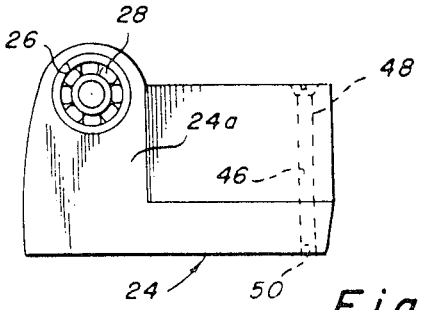
FIG. 6 is a side view of the tailpiece member having a string attachment device mounted thereon.
Figure 13:
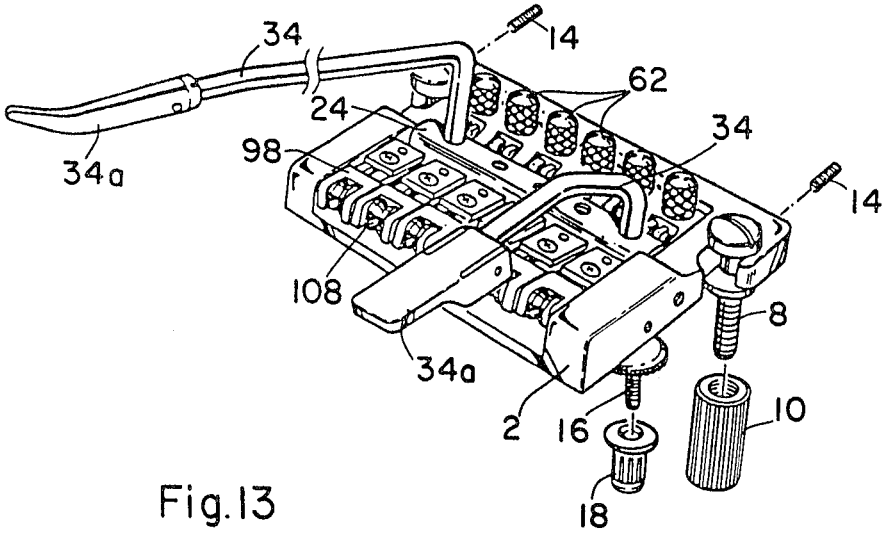

The tailpiece member has string attachment devices mounted thereon as shown in FIGS. 5–7. It will be appreciated that tensioning of the instrument strings will normally bias the tailpiece member in one direction of rotation. In FIG. 5 there is shown an adjustable string attachment device to which the ends of the strings of the muscial instrument are attached. The device includes a base 44 including first vertical through-openings 46 adapted to receive screws 48 for connecting the base with the tailpiece member, which also includes threaded openings 50 aligned with the first openings 46 and is adapted to receive the screws 48. The base 44 includes in its upper surface a plurality of longitudinally spaced recesses 51 adapted to receive a plurality of inset members 52, respectively. The inset members 52 are pivotally connected with the base by a first longitudinally extending rod 54 which passes through aligned openings 56 contained in the base and aligned openings 58 contained in the insert members. Each inset member includes a hook portion 52a which receives an instrument string and to which the eyelet portion of the string end is attached, and a tongue portion 52b. The base member further includes a plurality of second vertical threaded openings 60 adapted to receive a plurality of thumbscrews 62, respectively, the lower end of each thumbscrew being adapted to engage the tongue portion 52b of one of the inset members. Adjustment of the individual thumbscrews operates to individually pivot the inset members to horizontally displace the hook portions thereof, thereby to horizontally adjust the string ends.

In FIG. 7 there is shown an alternate embodiment of a string attachment device which is not adjustable. The base 64 of the device contains through-openings 66 adapted to receive screws 68 for connecting the base with the tailpiece member in the same manner that the base of the adjustable string attachment device of FIG. 5 is connected with the tailpiece member. The forward portion of the base 64 contains a plurality of longitudinally spaced recesses 70 within which the eyelets of the instrument string ends are attached.

As set forth above, tension of the strings attached to the attachment device mounted on the tailpiece member normally biases the tailpiece member in one direction of rotation. Shown in FIGS. *9a–9e* are a pair of springs connected with the tailpiece member for biasing the member in the other direction against the rotating force of the strings. As shown in FIGS. *9b* and *9d*, the tailpiece member 24 contains a centrally arranged recess 72 in the lower surface thereof. A T-shaped member 74 is pivotally connected with the tailpiece member by a pin 76 which passes through aligned openings 78 and 80 in the tailpiece member and T-shaped member, respectively. Pivotal movement of the T-shaped member is adjusted by a screw 82 which passes through a vertical threaded through opening 84 in the upper portion 24*a* of the tailpiece member, the lower end of the screw abutting against the T-shaped member as shown in FIGS. *9a*, *9c*, *9d*, and *9e*. One end of each of a pair of springs 86 is connected with the outer portion of the T-shaped member by a screw 88 cooperating with a threaded opening 90 in the T-shaped member, and the other end of each spring is connected with the underside of the tailpiece block. Adjustment of the screw 82 rotates the T-shaped member 74 about the pin 76, thereby to provide a gear reduction to vary the biasing force of the springs 86 against the rotating force exerted on the tailpiece member by the tensioned springs.

The tailpiece assembly further includes a bridge connected with the tailpiece block for individually guiding the instrument strings to the string attachment devices mounted on the tailpiece member. Referring to FIG. 2, the bridge is rotatably connected with the tailpiece block by a second longitudinal rod 92 which is arranged within the pair of aligned openings 20 in the tailpiece block.

A preferred embodiment of the bridge is illustrated in FIG. 10. A plurality of longitudinally spaced journal blocks 94 are provided, there being one journal block for each of the instrument strings. Each journal block contains a longitudinal opening 96 adapted to receive the second longitudinal rod, whereby the journal block is pivotal in a vertical plane relative to the tailpiece block. A support member 98 is adapted to horizontally mate with the journal block. A pressing plate 100 connected with the journal block 94 by a screw 102 cooperating with a through-opening 104 in the plate and a threaded opening 106 in the journal block, secures the support member in a fixed horizontal position relative to the journal block. The support member is horizontally adjustable relative to the journal block by loosening the screw 102, horizontally sliding the support member to the desired position relative to the journal block, and then tightening the screw. The support member 98 has a saddle roller 108 for supporting an instrument string and rotatably connected therewith by a pin 110 which passes through aligned openings 112 and 114 in the roller and support member, respectively. The support member further contains a vertical threaded opening 116 adapted to receive a screw 118, the lower end of which is adapted to engage the cross member 4 of the tailpiece block. Accordingly, rotation of the screw 118 vertically displaces the support member to vertically displace the saddle roller relative to the tailpiece block.

In addition to the aforementioned horizontal and vertical adjustments of the individual journal mechanisms of the saddle rollers which collectively form the bridge for guiding the strings to the string attachment devices, the journal mechanisms are longitudinally adjustable. Specifically, the pressing plate 100 and the journal block 94 each contain aligned threaded through openings 120 and 122, respectively, adapted to receive a screw 124. Before tightening of the screw, the journal block is displaced longitudinally along the rod 92 to the desired position. The screw 124 is then tightened, whereby the lower end thereof engages the rod 92 to secure the journal block in the desired longitudinal position. The bridge of FIG. 10 is therefore adjustable in three dimensions for each string of the instrument, namely, horizontally, vertically, and longitudinally. Furthermore, rotation of the saddle roller relative to the support member affords accurate string support in the event of changing tension forces on the instrument strings without damaging the string due to limited friction therebetween.

An alternate embodiment of a bridge assembly is shown in FIGS. 11*a*–11*f*. A longitudinal mounting bar 126 contains a longitudinal opening 128 adapted to receive the rod 92 for pivotal connection with the tailpiece block. The mounting bar contains in its upper surface a plurality of longitudinally spaced slots 130 each of which is adapted to receive a journal block 132. Each journal block contains a threaded opening 134 adapted to receive a screw 136. The screw passes through the opening in the journal block and contains a relief in the end portion thereof to receive a circlip 138 which is engaged in a slot of the mounting bar. A spring 140 is arranged about the screw 136 to bias the journal block away from the mounting bar, and rotation of the screw displaces the journal block along the length thereof. A saddle roller 142 is rotatably connected with the saddle block by a pin 144 which passes through aligned openings in the roller and journal block. The journal block further contains a pair of vertical threaded openings 146 adapted to receive screws 148, the lower ends of which abut against the cross member 4 of the tailpiece block. Rotation of the screws 148, therefore, vertically displaces the journal block and associated saddle roller relative to the tailpiece block.

It is apparent that one advantage of the tailpiece assembly is that the bridge assemblies and/or string attachment means are readily removable from the assembly and replaceable with those of a different configuration in accordance with the preferences of the player of the stringed instrument on which the device is mounted.

In operation, the player of the instrument adjusts the individual journal blocks of the bridge assembly in accordance with the strings supported thereby. Once adjusted, the entire bridge assembly is rigidly clamped about the rod 92 relative to the tailpiece block. Similarly, the player may fine tune the device by operating the thumbscrews of the string attachment devices to the desired degree for each string of the instrument. During play, rotation of the tailpiece member by the lever will produce a vibrato effect owing to a change in tension on the instrument strings. Because of the eccentric orientation of the rotational axis of the tailpiece member, the vibrato effect produced by the assembly is significantly greater than the vibrato effect produced by prior devices, thereby producing a wider range of tones.

In accordance with the invention, a string securing device is mounted on the neck of the stringed instrument behind the instrument nut. The string securing device enhances the operation of the combined bridge and tailpiece assembly to produce a more uniform vibrato effect as will be described with reference to FIGS. 12a–12d wherein the string securing device is shown. The device includes a base 150 connected with the instrument behind the instrument nut by any suitable means. The base has an upright portion 150a which contains a plurality of spaced recesses 152 adapted to receive a plurality of cross-shaped members 154, respectively, which are pivotally connected therein by a rod 156 which passes through aligned openings 158, 160 contained in the cross-shaped members and base, respectively. The base further contains a plurality of longitudinally spaced horizontal openings 164, each of which is adapted to receive one of the instrument strings 166 (FIG. 12c) which pass over a metal insert 168 on the main portion 150b of the base. A T-shaped metal plate 170 is connected within the recesses of the base upright portion by a screw 172 with the cross portion 170a of the plate overlying the metal insert with the instrument string arranged therebetween as shown in FIG. 12c. A thumbscrew 174 cooperates with aligned through openings 176 and threaded openings 178 in the cross-shaped member and base, respectively, to pivot the cross-shaped member up and down about the rod 156. The cross-shaped member 154 contains a pair of further threaded openings 180 adapted to receive screws 182, the lower ends of which engage the metal plate 170. Thus, when the thumbscrew 174 is operated to pivot the cross-shaped member downwardly, the screws 182 press the plate 170 against the instrument string to secure the same. The screws 182 are individually adjustable for securing adjacent instrument strings of different sizes. Securing the strings behind the nut prevents the strings from being drawn across the string grooves of the nut during rotation of the tailpiece member to produce the vibrato effect, thereby avoiding incorrect tuning.

While the assembly may be formed from any suitable material, brass is the preferred material with the screws, rods, and pins preferably being made of steel.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. An adjustable bridge for supporting the strings of a musical instrument, comprising (a) mounting bar means connected with the musical instrument and having a longitudinal axis; and (b) a plurality of bridge elements connected with said mounting bar means for supporting the instrument strings, respectively, each of said bridge elements comprising (1) journal block means adjustably mounted on said mounting bar means for pivotal and longitudinal movement relative thereto;

(2) means for rigidly fixing said journal block means in an adjusted position on said mounting bar means;

(3) string support means adjustably connected with said journal block means, respectively, for movement normal to said mounting bar axis, whereby said string support means are adjustable longitudinally of the instrument strings, respectively; and (4) means for rigidly fixing said string support means in an adjusted position relative to said journal block means, respectively.

2. An adjustable bridge as defined in claim 1, wherein said string support means includes means for vertically adjusting said string support means relative to the musical instrument for adjusting the string height from the musical instrument.

3. An adjustable bridge as defined in claim 2, wherein said string support means further comprises roller means for supporting the string, said roller means being continually freely rotatable about the axis thereof.

4. An adjustable bridge as defined in claim 3, wherein said roller means comprises saddle rollers.

5. An adjustable bridge as defined in claim 1, wherein said means for fixing said string support means to said journal block means comprises (a) complementary spline means on said string support means and said journal block means for permitting only movement of said string support means normal to said mounting bar axis; and (b) means for rigidly clamping said spline means together.

6. An adjustable bridge as in claim 5, wherein said spline means includes a flat upper surface on said journal block means, an integral rib projecting upwardly from said flat surface medially thereon, a pair of arms integral with said string support means defining a slot therebetween, said arms adapted for sliding movement on said flat surface with said projecting rib being slidably received in said slot, and said clamping means comprising a plate overlying said arms and rib, and screw means passing through an aperture in said plate into threaded engagement with said projecting rib to rigidly clamp said arms to said flat surface.

7. An adjustable bridge as defined in claim 1, wherein said mounting bar means comprises a cylindrical rod passing through a complementary opening in said journal block means, and further wherein said means for fixing said journal block to said mounting bar means comprises a set screw threaded through said journal block means into engagement with said cylindrical rod.

* * * * *